US006768398B2

(12) United States Patent
Callaway, Jr. et al.

(10) Patent No.: US 6,768,398 B2
(45) Date of Patent: Jul. 27, 2004

(54) METHOD AND APPARATUS FOR CREATING A RADIO FREQUENCY FILTER

(75) Inventors: Edgar Herbert Callaway, Jr., Boca Raton, FL (US); Raymond Louis Barrett, Jr., Ft. Lauderdale, FL (US); Gilberto Jacinto Hernandez, Miami, FL (US); Douglas Harold Weisman, Sunrise, FL (US)

(73) Assignee: Motorola, Inc., Schaumburg, IL (US)

( * ) Notice: Subject to any disclaimer, the term of this patent is extended or adjusted under 35 U.S.C. 154(b) by 171 days.

(21) Appl. No.: 10/021,636

(22) Filed: Dec. 12, 2001

(65) Prior Publication Data

US 2003/0107458 A1 Jun. 12, 2003

(51) Int. Cl.[7] ..... H01P 1/203; H01P 1/20
(52) U.S. Cl. ..... 333/204; 333/202; 333/34
(58) Field of Search ..... 333/204, 202, 333/34

(56) References Cited

U.S. PATENT DOCUMENTS 3,585,499 A * 6/1971 Bolie ..... 324/76.35
5,856,722 A * 1/1999 Haronian et al. ..... 310/321

OTHER PUBLICATIONS

M.R. Schroeder, "An Integrable Model for the Basilar Membrane"; Mar. 15, 1972; pp. 429–434.

Chas R. Burrows; "The Exponential Transmission Line"; Oct. 1938; pp. 555–573.

Lawrence N. Dworsky; "Modern Transmission Line Theory and Applications"; 1988; pp. 203–208.

* cited by examiner

*Primary Examiner*—Stephen E. Jones

(57) ABSTRACT

A transmission line (218) is formed to have a characteristic impedance which increases at a first substantially exponential rate with respect to a distance from the input (202). A plurality of resonators (206–214) are coupled to the transmission line and positioned at a plurality of locations along the transmission line. The plurality of resonators has resonant frequencies that decrease at a second substantially exponential rate with respect to the distance from the input. An output signal (810, 812) is obtained at a point in the filter that produces a filter response having a corner frequency.

20 Claims, 3 Drawing Sheets

-PRIOR ART-

200

300

400

500

600

700

800

900

METHOD AND APPARATUS FOR CREATING A RADIO FREQUENCY FILTER

FIELD OF THE INVENTION

This invention relates in general to communication systems, and more specifically to a method and apparatus for creating a radio frequency filter.

BACKGROUND OF THE INVENTION

Hardware suitable for a Software Defined Radio (SDR), in addition to its many other requirements, must be frequency agile. That is to say, in order to be truly useful, the RF section must be able to cover a wide bandwidth. However, it is insufficient to simply create a wideband, untuned RF section, since in order to meet the RF performance specifications of many services with practical components it is necessary to provide more narrowband band pass filtering, or at least low pass filtering, to reject image frequencies, spurious responses, blockers, and other undesirable signals in a receiver, and harmonics, spurious responses, far-out noise, and other undesirable signals in a transmitter. For an SDR it is desirable that band pass RF filtering be adjustable in both center frequency and bandwidth, to provide the greatest flexibility. Similarly, if low pass filtering is employed, it is desirable that the low pass filtering have a selectable corner frequency. In addition, users are now enjoying the low power consumption and excellent dynamic range of fixed, passive RF selectivity in their single-mode radios. A successful SDR should have similar performance to be successful in the marketplace.

No truly satisfactory solution to this requirement exists in the prior art. One prior-art SDR design incorporates a large number of switchable, passive band pass RF filters, each of which may be individually varactor tuned. While this brute-force approach works, it is not a technology transferable to small, low-cost portable equipment. Many types of active filtering have been suggested for the SDR application, from $g_m$C filters to logarithmic filtering, but they all suffer from dynamic range and current drain limitations when compared to the passive filtering used in existing products.

What is needed is a method and apparatus for creating a multi-band RF filter that is flexible in both center frequency and bandwidth, and that maintains the current drain and dynamic range performance of passive RF filters.

BRIEF DESCRIPTION OF THE DRAWINGS

The accompanying figures, where like reference numerals refer to identical or functionally similar elements throughout the separate views and which are incorporated in and form part of the specification, serve to further illustrate various embodiments in accordance with the present invention. The figures together with the detailed description, hereinafter below, serve to explain various principles and advantages in accordance with the present invention.

DETAILED DESCRIPTION OF THE DRAWINGS

In overview form the present disclosure concerns a method and structure for filtering, particularly suited for radio frequency filtering at frequencies into the many GHz ranges. Furthermore in a preferred form this filter structure and methodology is flexible and provides for low pass and band pass filters with separately programmable center frequency and filter bandwidths. This is especially advantageous in radios that are software programmable for varying frequency bands.

The instant disclosure is provided to further explain in an enabling fashion the best modes of making and using various embodiments in accordance with the present invention. The disclosure is further offered to enhance an understanding and appreciation for the inventive principles and advantages thereof, rather than to limit in any manner the invention. The invention is defined solely by the appended claims including any amendments made during the pendency of this application and all equivalents of those claims as issued. It is further understood that the use of relational terms, if any, such as first and second, top and bottom, and the like are used solely to distinguish one from another entity or action without necessarily requiring or implying any actual such relationship or order between such entities or actions.

Figure 1:
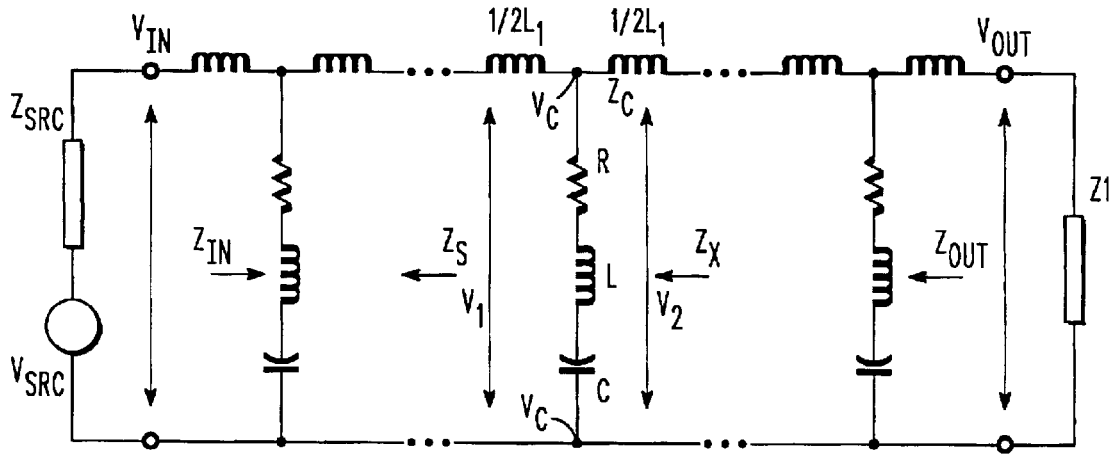
FIG. 1 is an electrical schematic diagram of a prior-art lumped-element model of the basilar membrane of the mammalian cochlea.

Referring to FIG. 1, an electrical schematic diagram depicts a lumped-element model 100 of the basilar membrane of the mammalian cochlea, as disclosed by Schroeder (M. R. Schroeder, "An integrable model for the basilar membrane," *Journal of the Acoustical Society of America*, v. 53, no. 2, 1973, pp. 429–434). An aspect of the present invention comprises a practical implementation of Schroeder's model, applied to RF filtering. The ear seems a good place to look for assistance in creating a Software Defined Radio (SDR) RF filter due to its wide bandwidth (3 decades), very flexible filtering capability, and use of low-Q structures to obtain very sharp roll off responses.

Schroeder models the ear's basilar membrane by use of lumped elements, in a manner reminiscent of a lumped-element model of a transmission line. However, in his model 100 the shunt arms are series-resonant structures, rather than the capacitors of the well-known transmission line model. This gives rise to the notion of using open-circuit transmission line stubs for the shunt arms; they will be series resonant when they are ¼ wavelength long. Schroeder indicates that the frequencies of resonance of the shunt arms (i.e., stubs, according to the present invention) should decrease exponentially as one travels away from the input, and that the low frequency phase velocity be proportional to the shunt arms' frequencies of resonance. This phase velocity requirement is accomplished in accordance with the present invention by exponentially increasing the characteristic impedance of the transmission line with distance from the input. Finally, Schroeder assumes that the damping factor (i.e., Q) of the shunt arms (stubs) should remain constant. All of these criteria may be met at RF using micro stripline, which is particularly convenient to use since, in one embodiment, the outputs are to be voltages at points along the structure. One of ordinary skill in the art, however, will recognize that other types of RF transmission line including, but not limited to, stripline, coplanar waveguide, slotline, coaxial line, and parallel line, may be used within the scope of the present invention. One of ordinary skill in the art will also recognize that combinations of RF transmission line types, and combinations of one or more RF transmission line types with discrete components, such as series inductors or shunt capacitors, may also be utilized.

Figure 2:
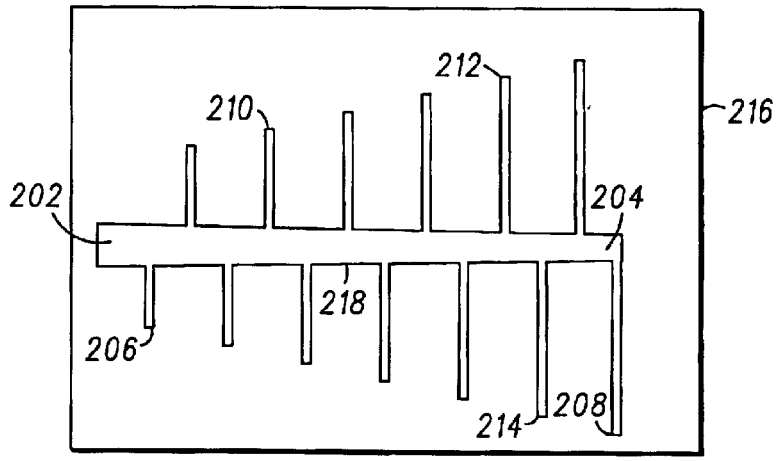
FIG. 2 is a top view of a micro stripline filter structure in accordance with the present invention.

FIG. 2 is a top view of a micro stripline filter structure 200 in accordance with the present invention. The structure 200 is preferably arranged such that the filter is a model of a basilar membrane of a mammalian cochlea. The structure 200 is a first-generation test structure, arranged to cover an operating frequency range from 1 to 2 GHz with 13 resonators, or stubs 206–214 (not all stubs are numbered). It will be appreciated that, in a product implementation, many more resonant stubs, spaced closer together, can be used. Since the desired frequency range covers a 2:1 ratio, the characteristic impedance of the transmission line 218 does also, rising exponentially from fifty ohms at the input 202 to one hundred ohms at the distal end 204. The length of the transmission line is arbitrary; however, to best model the distributed nature of the mammalian cochlea, and to minimize ripple in the filter passband, as many resonators as is practical should be employed. Each resonator is longer than its predecessor (i.e., the frequency of resonance is lower) by the same exponential proportion as the transmission line impedance increases with the distance from the input 202.

In somewhat more detail, the micro stripline filter structure 200 preferably is formed through conventional techniques, using conventional materials, on a conventional substrate 216. The filter structure 200 comprises the input 202 for receiving an input signal, and the transmission line 218 coupled to the input 202. The transmission line 218 has characteristic impedance that increases at a first substantially exponential rate with respect to the distance from the input 202. Here, it may be helpful to explain what is meant by "substantially exponential rate." An exponential function is a function of the form $f(x)=ay^{(bx)}+c$, where a, b, c, and y are constants. A familiar example is $f(x)=e^{x}$, for which a=1, b=1, c=0, and y=e=2.7182818, which is the base of the natural logarithms. An exponential can be represented by an infinite power summation, $f(x)=SuM[(x^{n})/n!]$, for n=0 to infinity. The first few terms are $1+x+(x^{2})/2+(x^{3})/6+\ldots$ It follows then that a substantially exponential rate is a rate that can be represented by a function approximating an exponential to a great extent or degree, especially one that may be represented by a truncation of the power summation representation of the exponential. A few examples are: constant functions (1), linear functions (1+x), and quadratic functions $(1+x+(x^{2})/2)$.

Preferably, the transmission line 218 is arranged and formed such that the characteristic impedance at a distal end of the transmission line divided by the characteristic impedance at the input is substantially equal to (e.g. within 25% plus ordinary build tolerances of) a desired upper operating frequency range limit divided by a desired lower operating frequency range limit. In one embodiment, the transmission line 218 is arranged and formed as a micro stripline transmission line, tapered such that the characteristic impedance increases at a predetermined substantially exponential rate with respect to the distance from the input.

A plurality of resonators 206–214 is coupled to the transmission line 218. The plurality of resonators 206–214 are positioned at a plurality of points along the transmission line 218 and have resonant frequencies which decrease at a second substantially exponential rate with respect to the distance from the input 202. In one embodiment, the plurality of resonators are formed as a plurality of micro stripline stubs arranged such that, compared to a stub closest to the input 202, each additional stub increases in length at said predetermined substantially exponential rate with respect to the distance from the input 202. In another embodiment, the plurality of resonators 206–214 are arranged and formed to have a substantially constant damping factor. In yet another embodiment, the first substantially exponential rate and the second substantially exponential rate are substantially equal to (e.g. within 25% plus ordinary build tolerances of) one another.

Figure 3:
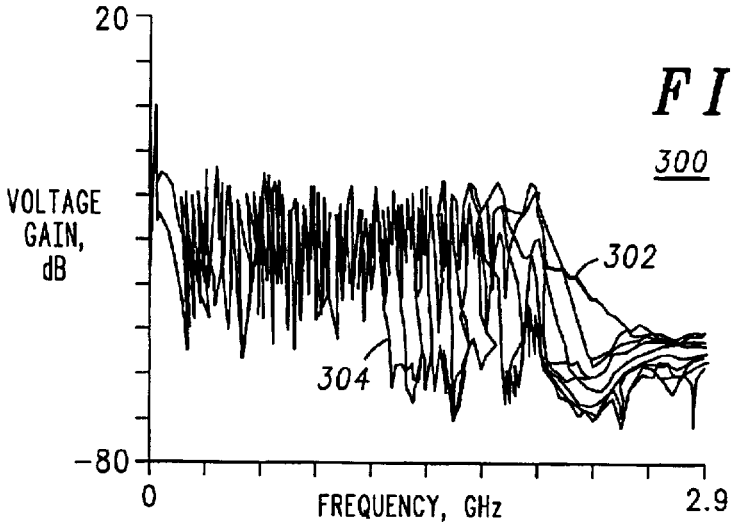
FIG. 3 depicts multiple-node low pass responses of the micro stripline filter structure in accordance with the present invention.

FIG. 3 depicts multiple-node low pass responses 300 of the micro stripline filter structure 200 in accordance with the present invention. The responses measured at each of the 13 stubs 206–214 are combined in FIG. 3, beginning with the response 302 taken at the stub 206 and ending with the response 304 taken at the stub 208. The responses 300 show the monotonically decreasing corner frequency of the low pass response as one moves away from the input 202 of the structure 200. (The output was taken with a high impedance RF probe, which limited the achievable noise floor of the measurements.)

Figure 4:
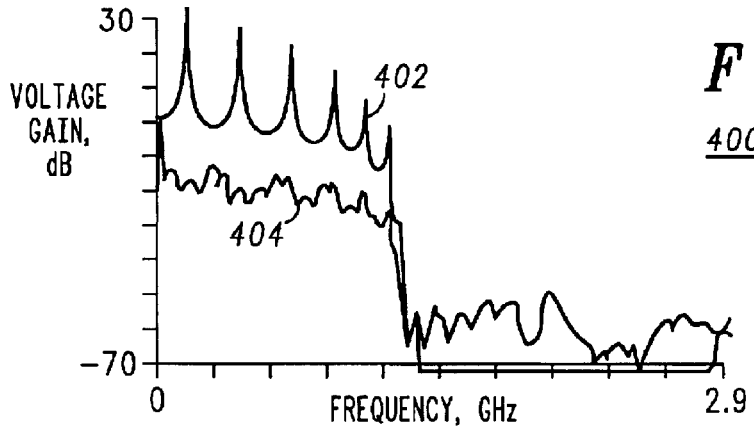
FIGS. 4 and 5 depict single-node low pass responses of the micro stripline filter structure in accordance with the present invention.
Figure 5:
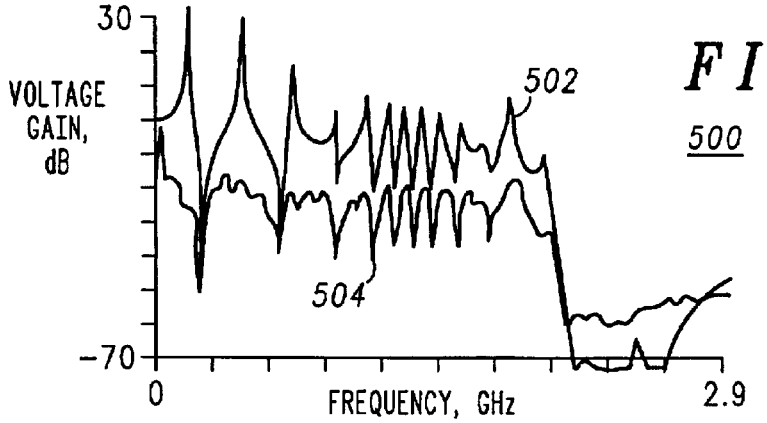

FIGS. 4 and 5 depict single-node low pass responses 400, 500, respectively, of the micro stripline filter structure 200 in accordance with the present invention. The responses 402 and 404 in FIG. 4 are simulated and measured low pass responses (magnitude), respectively, taken at the stub 208, farthest from the input 202. Here, the corner frequency is approximately 1.2 GHz. The responses 502 and 504 in FIG. 5 are simulated and measured low pass responses, respectively, taken at the stub 210, fourth from the input 202. Here, the corner frequency is approximately 2 GHz advantageously changing the corner frequency of the filter's low pass response.

Figure 6:
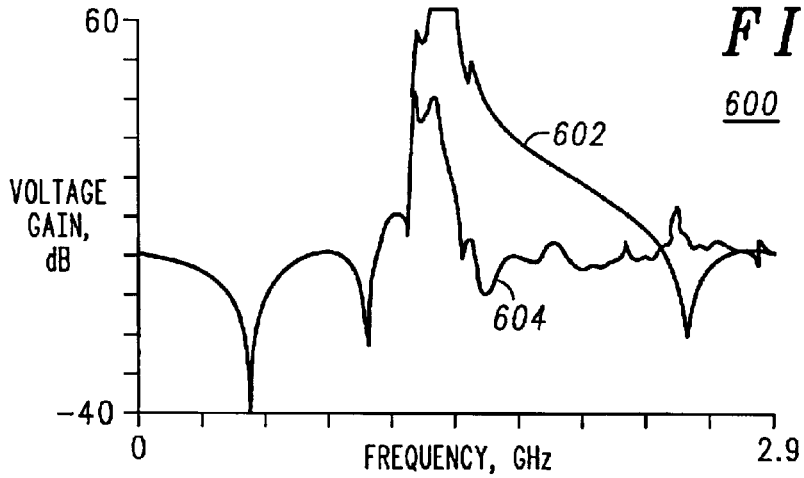
FIGS. 6 and 7 depict two-node band pass responses of the micro stripline filter structure in accordance with the present invention.
Figure 7:
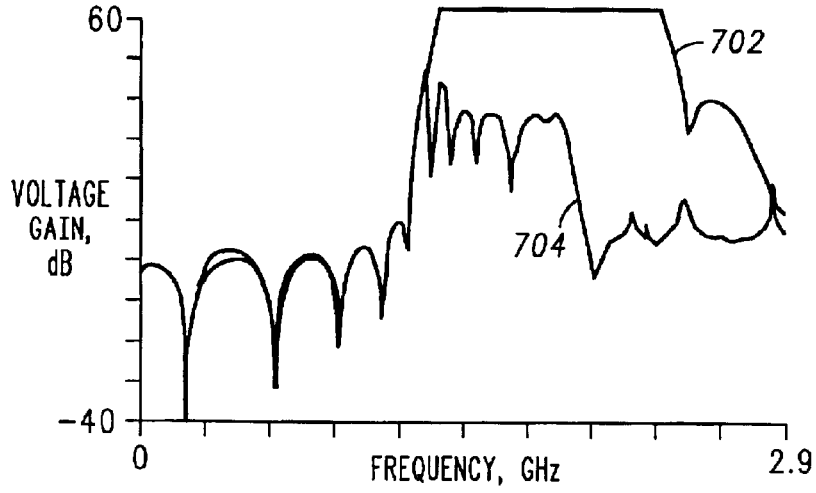

Band pass responses may be obtained from the difference of the magnitudes of two lowpass responses. This is possible because the structure 200 has multiple outputs that may be accessed simultaneously. FIGS. 6 and 7 depict two-node band pass responses of the micro stripline filter structure 200 in accordance with the present invention. FIG. 6 depicts the difference 600 between outputs taken at the stubs 212 and 214 in both simulated and measured curves 602, 604, which show a relatively narrow pass band. FIG. 7 depicts the difference 700 between outputs taken at the stubs 210 and 208 in both simulated and measured curves 702, 704, which show a relatively wide pass band. Both of these responses show the effects of the high experimental noise floor. The difference between any two low pass responses may be taken, advantageously allowing independent adjustment of center frequency and width of the pass band.

Figure 8:
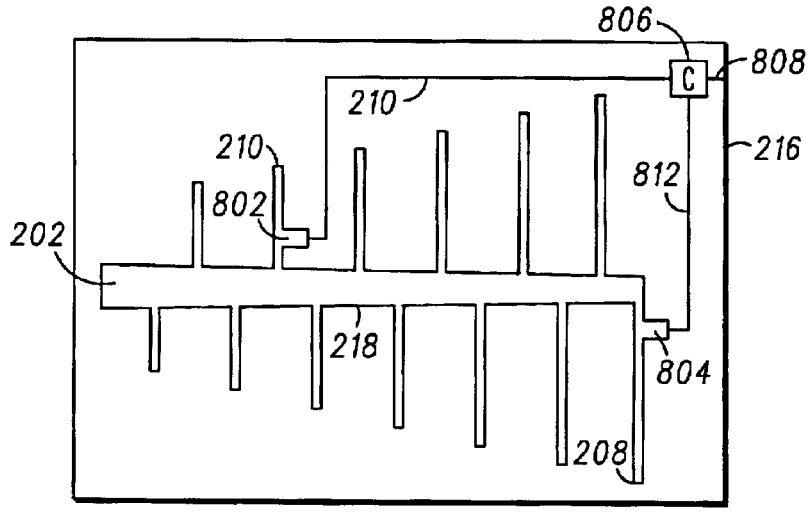
FIG. 8 is a top view of an exemplary radio frequency filter in accordance with the present invention.

FIG. 8 is a top view of an exemplary radio frequency filter 800 in accordance with the present invention. The filter 800 is similar to the filter structure 200, the essential difference being the addition of first and second output elements 802, 804 coupled to the stubs 210, 208 for deriving output signals therefrom, and a combiner 806 coupled to the output elements 802, 804 through first and second outputs 810, 812 for producing a combined output signal at a combined output line 808. The first and second output elements 802, 804 preferably are conventional field-effect transistors (FETs), such as GaAs FETs, having low-capacitance gates connected to the stubs 210, 208 at a point near, but not at, the transmission line 218. The combiner 806 preferably utilizes well-known techniques to determine the difference in the magnitudes of the output signals for generating the combined output signal.

It will be appreciated that, alternatively, additional output elements can be positioned at additional stubs 206–214, along with conventional signal-selection elements, so that different combinations of outputs can be combined to adjust the filter center frequency and pass band width, under software control. It will be further appreciated that instead of an electric output coupling (e.g., the FET), one can place a loop near ones of the stubs 206–214, and couple to them magnetically. One can also couple electro-magnetically, by placing a second resonant stub near the desired output. In addition, one can couple to the transmission line 218 itself to derive the output signal(s).

Figure 9:
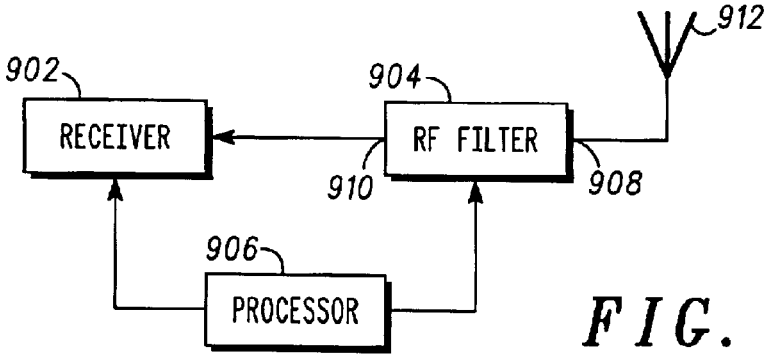
FIG. 9 is an electrical block diagram of an exemplary radio frequency device comprising a multi-band radio frequency filter in accordance with the present invention.

FIG. 9 is an electrical block diagram of an exemplary radio frequency device 900 comprising a multi-band radio frequency filter in accordance with the present invention. The device 900 comprises a conventional RF receiver 902 and an RF filter 904 in accordance with the present invention. The RF filter 904 comprises an input 908 coupled to an antenna 912 for receiving an input signal therefrom. The RF filter 904 further comprises a filter element modeled on a basilar membrane of a mammalian cochlea, similar to the filter 800, and preferably equipped with a plurality of output elements 802, 804 selectable under software control. The RF filter 904 further comprises an output 910 coupled to the RF receiver 904 for providing an output signal thereto. The device 900 further comprises a conventional processor 906 coupled to the receiver 902 for controlling the same, and further coupled to the RF filter 904 for adjusting the center frequency and bandwidth of the RF filter 904 under software control by selecting specific ones of the output elements 802, 804 to be combined. It will be appreciated that, in an alternative embodiment, an RF transmitter or an RF transceiver can replace the RF receiver 902.

Thus, it should be clear from the preceding disclosure that the present invention provides a method and apparatus for creating a multi-band RF filter that is flexible in both center frequency and bandwidth, and that maintains the current drain and dynamic range performance of passive RF filters.

Many modifications and variations of the present invention are possible in light of the above teachings. Thus, it is to be understood that, within the scope of the appended claims, the invention can be practiced other than as described herein above.

What is claimed is:

1. A radio frequency filter, the filter comprising:

an input for receiving an input signal;

a transmission line coupled to the input, the transmission line having a characteristic impedance which increases at a first substantially exponential rate with respect to a distance from the input;

a plurality of resonators coupled to the transmission line, the resonators positioned at a plurality of points along the transmission line and having resonant frequencies which decrease at a second substantially exponential rate with respect to the distance from the input; and an output coupled to a point in the filter that produces a filter response having a corner frequency.

2. The filter of claim 1, further comprising multiple outputs coupled to multiple physically separated points in the filter for producing multiple output signals with multiple filter responses having different corner frequencies.

3. The filter of claim 1, further comprising:

at least two outputs coupled to at least two physically separated points in the filter for producing at least two output signals; and a combiner coupled to the at least two outputs for combining the at least two output signals to establish a band pass response.

4. The filter of claim 1, wherein the transmission line is arranged and formed such that the characteristic impedance at a distal end of the transmission line divided by the characteristic impedance at the input is substantially equal to a desired upper operating frequency range limit divided by a desired lower operating frequency range limit.

5. The filter of claim 1, wherein the transmission line is arranged and formed as a micro stripline transmission line, tapered such that the characteristic impedance increases at a predetermined substantially exponential rate with respect to the distance from the input; and wherein the plurality of resonators are formed as a plurality of micro stripline stubs arranged such that, compared to a stub closest to the input, each additional stub increases in length at said predetermined substantially exponential rate with respect to the distance from the input.

6. The filter of claim 1, wherein the output comprises an element for obtaining the output signal through at least one of an electric, a magnetic, and an electromagnetic coupling to a resonator of the plurality of resonators.

7. The filter of claim 1, wherein the output comprises an element for obtaining the output signal through at least one of an electric, a magnetic, and an electromagnetic coupling to the transmission line.

8. The filter of claim 1, wherein the plurality of resonators are arranged and formed to have a substantially constant damping factor.

9. The filter of claim 1, wherein the first substantially exponential rate and the second substantially exponential rate are substantially equal to one another.

10. The filter of claim 1, arranged such that the filter is a model of a basilar membrane of a mammalian cochlea.

11. A method for creating a radio frequency filter having an input, the method comprising the steps of:

forming a transmission line having a characteristic impedance which increases at a first substantially exponential rate with respect to a distance from the input;

coupling to the transmission line a plurality of resonators positioned at a plurality of locations along the transmission line and having resonant frequencies which decrease at a second substantially exponential rate with respect to the distance from the input; and obtaining an output signal at a point in the filter that produces a filter response having a corner frequency.

12. The method of claim 1, wherein the obtaining step comprises the step of obtaining multiple output signals at multiple physically separated points in the filter to produce multiple filter responses having different corner frequencies.

13. The method of claim 1, wherein the obtaining step comprises the steps of:

obtaining at least two output signals from at least two physically separated points in the filter; and combining the at least two output signals to produce a band pass response.

14. The method of claim 1, wherein the forming step comprises the step of arranging the transmission line such that the characteristic impedance at a distal end of the transmission line divided by the characteristic impedance at the input is substantially equal to a desired upper operating frequency range limit divided by a desired lower operating frequency range limit.

15. The method of claim 1, wherein the forming step comprises the step of forming a micro stripline transmission line, tapered such that the characteristic impedance increases at a predetermined substantially exponential rate with respect to the distance from the input; and wherein the coupling step comprises the step of coupling a plurality of micro stripline stubs arranged such that, compared to a stub closest to the input, each additional stub increases in length at said predetermined substantially exponential rate with respect to the distance from the input.

16. The method of claim 1, wherein the obtaining step comprises the step of obtaining the output signal through at least one of an electric, a magnetic, and an electromagnetic coupling to a resonator of the plurality of resonators.

17. The method of claim 1, wherein the obtaining step comprises the step of obtaining the output signal through at least one of an electric, a magnetic, and an electromagnetic coupling to the transmission line.

18. The method of claim 1, wherein the coupling step comprises the step of forming the plurality of resonators such that the plurality of resonators have a substantially constant damping factor.

19. The method of claim 1, wherein the first substantially exponential rate and the second substantially exponential rate are substantially equal to one another.

20. The method of claim 1, further comprising the step of arranging the multi-band radio frequency filter such that the filter is a model of a basilar membrane of a mammalian cochlea.

* * * * *